US005598969A

United States Patent [19]

Ong

[11] Patent Number: 5,598,969

[45] Date of Patent: Feb. 4, 1997

[54] FOLDER INSERT

[76] Inventor: Bon S. Ong, P.O. Box 4247, Torrance, Calif. 90510

[21] Appl. No.: 419,900

[22] Filed: Apr. 11, 1995

[51] Int. Cl.[6] ..... B65D 27/08

[52] U.S. Cl. ..... 229/67.1; 229/72

[58] Field of Search ..... 229/67.1, 72; 462/12, 462/67, 68; 281/38, 40

[56] References Cited

U.S. PATENT DOCUMENTS

| | | | |
|---|---|---|---|
| 212,762 | 2/1879 | Stromberg | 229/67.1 X |
| 1,464,378 | 8/1923 | Wilburger | 229/72 |
| 1,495,953 | 5/1924 | Dick | 281/38 X |
| 2,318,278 | 5/1943 | Arnold | 229/72 |
| 3,858,790 | 1/1975 | Humphrey | 229/72 |
| 4,313,558 | 2/1982 | Benham | 229/72 |
| 5,025,978 | 6/1991 | Pacione | 229/67.1 |

FOREIGN PATENT DOCUMENTS

| | | | |
|---|---|---|---|
| 0023952 | 1/1989 | Japan | 229/72 |

*Primary Examiner*—Jes F. Pascua
*Attorney, Agent, or Firm*—Charles H. Thomas

[57] ABSTRACT

A folder insert is provided for a bifolding folder or ring binder to expand the capacity thereof. The folder insert is formed of a single sheet of flat stock folded to form at least one rectangular support panel with opposing faces and at least one pair of separate pocket panels extending from the support panel. The pocket panels are folded across portions of the support panel against both of the opposing faces thereof and are anchored to the support panel along the bottom edge and at least one of the lateral edges of the support panel. The same sheet of flat stock includes an attachment flap extending along one of the lateral edges of the support panel. The attachment flap allows the folder insert to be attached inside a folder. In an alternative embodiment the sheet of flat stock forms a rectangular support panel and a single pocket panel folded across a portion of the support panel and is anchored thereto along the bottom edge and both of the lateral edges. The support panel and pocket panel form a pocket therebetween which may be provided with accordion folds to permit expansion.

4 Claims, 7 Drawing Sheets

FOLDER INSERT

BACKGROUND OF THE INVENTION

1. Field of the Invention

The present invention relates to a folder insert useful for expanding the capacity of a folder.

2. Description of the Prior Art

Office file folders have been used for many years to carry and protect papers and to serve as a means for organizing sheets of paper. One very simple and widely used form of folder is an office folio formed of an expansive sheet of stiff paper or card stock folded longitudinally to bifurcate the sheet into two leaves which fold together. The leaves serve as front and back covers of a file folder. Quite often the single sheet of material forming the folio includes extensions from the leaves which are folded back and secured to the leaves to form stiffening, marginal strips and sometimes pockets on he inside of either he front cover, the back cover, or both covers of the folio.

Convention folio folders of this type are very economical to manufacture and are widely utilized throughout innumerable types of offices and businesses. However, conventional folio folders of this type have only a very limited storage and organizing capacity. That is, in forming a folio folder of this type from a single sheet of flat sock the storage and organizing capacity of the folder is limited to a single pocket defined on the inside of the front folio cover and a single pocket defined on he inside of the back folio cover. Thus, if a user wishes to separate papers into more than two categories, additional, separate folio folders must be employed.

Where a user wishes to organize papers into several categories it is often cumbersome to be forced to carry, sort, and refer to a number of different folio folders. Also, it is oftentimes inconvenient to attempt to physically manipulate several different folio folders in order to locate particular papers stored in one of the folders.

SUMMARY OF THE INVENTION

One object of the present invention is to produce a folder insert which expands the capacity and reduces the physical manipulation of papers necessary to separate and categorize papers to be organized within a folder or binder. According to the invention a folder insert is provided which contains one or more pockets and which is capable of being easily and permanently inserted into a preexisting folder binder. While many of the embodiments of the folder insert of the invention are particularly adapted for insertion a conventional bifolding folio folder, he utility of the invention is no limited to such applications. Indeed, some of the embodiments of the invention are adapted for insertion into ring binders, prong binders, and comb binders. The type of folder or binder with which an insert according to the invention may be utilized is determined by providing the folder insert with a means of attachment compatible with he type of folder with which the folder insert is to be utilized.

In some embodiments the folder insert of he invention is provided with an attachment flap. This flap may take the form of a narrow, marginal strip running lengthwise along the folder insert and adapted for connection to a folio folder or other type of folder by means of adhesive, stitching, stapling, riveting, punched holes, heat sealing, heat fusing, and other methods of attachment. Alternatively, he attachment flap may take the form of an expansive, lateral extension that may be inserted into and captured within one of the pockets of a folio folder. Other means of attaching the folder insert into an existing folder or binder are also possible.

Another object of the invention is to provide a folder insert which considerable expands the organizational capacity of an existing folder. In certain preferred embodiments of the invention the folder insert is formed with at least one support panel having a pair of pocket panels disposed on the opposite faces of the support panel. This allows a single support panel to form the backing for two pockets, one defined at each face of the support panel. Furthermore, the holder insert may be formed as a longitudinally bifurcated structure of mirror-image configuration in which a pair of support panels are formed on either side of a central, longitudinal fold line and wherein each of the two support panels is provided with a separate pair of pockets as aforesaid.

A further object of the invention is to provide a holder insert that greatly expands the organizational capability of a folder and which may be formed from a single sheet of stiff, flat stock. A single sheet of material such as heavy paper or card stock may be die cut and folded to form a pair of pockets, one on each side of each support panel employed, merely by selection of an appropriate geometric configuration with which to die cut the stiff stock, and by folding the cut structure appropriately. Moreover, a plurality of support panels, each having a separate pair of pockets, one on each side thereof, may be formed from a single, flat sheet of thin stock.

Another object of the invention is to provide a holder insert which allows the capacity of a preexisting folder to be enhanced and expanded by the ultimate user. This allows a user to modify an existing folder by adding thereto any number of folder inserts constructed according to the invention. Thus, a user may add a holder insert to an existing folder to provide between the covers thereof any number of additional support panels. These support panels may be formed with a single pocket on one face thereof, in which case the pocket panel is preferably provided with fastening flaps that include accordion folds to allow the pocket to be expanded in thickness. On the other hand, each support panel may be provided with separate pocket panels extending across at least portions of its opposite faces to define separate pockets on the opposite faces of each support panel.

A further object of the invention is to provide a folder insert which can be attached to a preexisting folder quickly and easily by the ultimate user. The user thereby purchases a supply of folder inserts constructed according to the invention, and utilizes these inserts as appropriate expand the contents of existing folders as desired. When additional organizational categories are deemed desirable, the user merely takes a holder insert from a supply of such devices and attaches it to the folder that is in need of additional capacity.

A further object of the invention is to provide a holder insert which remains as a single thin, flat sheet of stock until use. This configuration allows a great number of holder inserts of this type to be packaged together in laminar sheets within a relatively small volume of space. This reduces the amount of storage space required and greatly facilitates shipping and delivery of large quantities of such inserts.

In one broad aspect the present invention may be considered to be a folder insert comprised of a single stiff sheet of flat stock folded to form at least one rectangular support panel with opposing faces. The support panel has mutually parallel top and bottom edges and mutually parallel lateral edges. The lateral edges are oriented perpendicular to the top and bottom edges. The single sheet of flat stock is also folded to form at least one pair of separate pocket panels that are folded across the support panel against each of the opposing faces of the support panel. The pocket panels are anchored to the support panel along the bottom edge and at least one of the lateral edges thereof. A folder insert so constructed thereby provides two pockets for each support panel employed from a single sheet of flat stock.

In another broad aspect the invention may be considered to be a folder insert formed from a single sheet of stiff, flat material folded to form at least one rectangular support panel and at least one pair of pocket panels. Each support panel has opposite faces and defines opposing, mutually parallel top and bottom edges and opposing, mutually parallel lateral edges that are oriented perpendicular to the top and bottom edges. The pocket panels in each pair of pocket panels are disposed to at least partially cover he opposite faces of a single support panel. The pocket panels are held to the support panel along the bottom edge and along at least one of the lateral edges thereof. In this way the pockets panels form a pair of pockets with the opposite faces of each support panel.

In another broad aspect the invention may be considered to be in improvement in a folder including a folio folded to form front and back covers. The improvement is comprised of a folder insert formed of a single sheet of flat material folded to delineate at least one rectangular support panel having opposite flat surfaces and bounded by mutually parallel top and bottom edges and mutually parallel lateral edges aligned perpendicular to the top and bottom edges. The folded sheet of material also delineates at least one pair of pocket panels as extending across both the opposing flat surfaces of the at least one rectangular support panel. The pocket panels are held to the support panel at the bottom and along at least one lateral edge thereof. The at least one support panel is interposed between the pocket panels in each pair of pocket panels. Each pair of pocket panels, together with the support panel with which they are associated, form separate pockets with both the flat surfaces of their associated support panel.

In still another broad aspect the invention may be considered to be a folder insert comprised of a single sheet of a flat card stock folded to form at least one rectangular support panel and having mutually parallel top and bottom edges and mutually parallel lateral edges oriented perpendicular to the top and bottom edges. The single sheet of stiff, flat stock also forms at least one pocket panel folded across a portion of the support panel and anchored thereto along the bottom edge and along both of the lateral edges. A pocket is thereby formed between the support panel and the pocket panel. The single sheet of stiff, flat stock also forms a folder attachment flap extending from one of the lateral edges of the support panel.

The attachment flap allows the folder insert to be joined to a preexisting folder, such as a folio, a prong binder, a ring binder, or any other conventional type of folder. The folder insert thereby enhances the capacity of conventional folders and expands the number of categories into which documents carried therewithin may be divided. The extent of storage and organizational enhancement is virtually unlimited, since any number of folder inserts may be added to a preexisting folder.

The invention may be described with greater clarity and particularity by reference to the accompanying drawings.

DESCRIPTION OF THE EMBODIMENT

Figure 1:
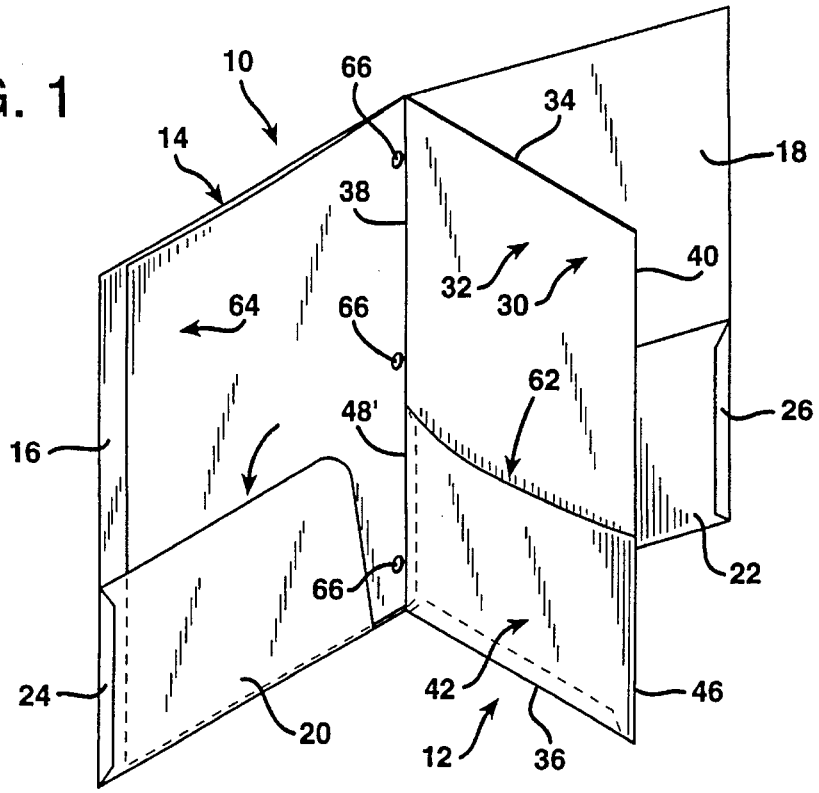
FIG. 1 is a perspective view illustrating a folder employing one embodiment of a folder insert according to the invention.

FIG. 1 illustrates an otherwise conventional, bifolded folio folder 10 formed of stiff paper or card stock into which a folder insert 12, constructed according to the invention, has been inserted. The folder 10 includes a folio 14 folded to form a rectangular front cover 16 and a rectangular back cover 18. As with conventional folio folders the stock from which the folio 14 is formed includes sufficient material to define a front cover folio pocket panel 20, a rear cover folio pocket panel 22, a front cover pocket closure flap 24, and a back cover pocket closure flap 26.

The front and back cover pocket panels 20 and 22 are formed, respectively, as extensions from the bottom edges of the front and back covers 16 and 18. The front and back cover pockets panels 20 and 22 ace folded upwardly and inwardly toward the structure of the front and back covers 16 and 18, respectively, and are closed along their laterally outer edges by the front and back pocket closure flaps 24 and 26. The inwardly facing surfaces of the pocket closure flaps 24 and 26 may be coated with an adhesive which thereby secures the cover pocket panels 20 and 22 shut along their laterally outer edges. The pockets thus formed between the front cover pocket panel 20 and the front cover 16 and between the rear cover pocket panel 22 and the rear cover 18 are therefore top and side-opening pockets, which open upwardly and toward the laterally inner, mutually adjacent edges of the front and back covers 16 and 18.

Figure 1A:
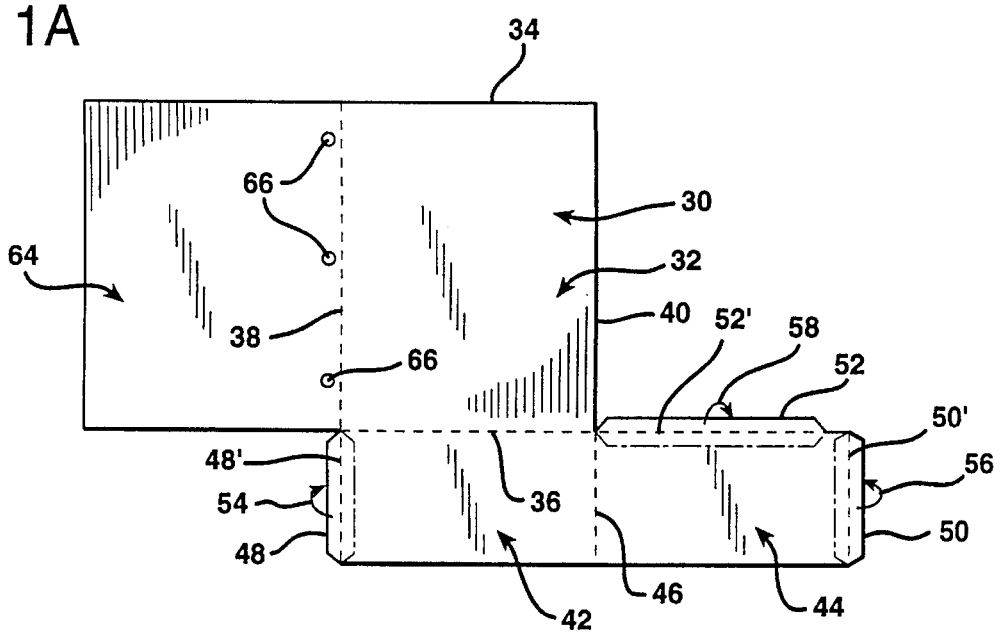
FIG. 1A is a plan view illustrating the sheet of stiff, flat material used to form the folder insert of FIG. 1 prior to folding.

The folder insert 12 employed in the embodiment of FIG. 1 is formed from a single sheet 30 of stiff, flat card or paper stock die cut to the shape depicted in FIG. 1A. The sheet 30 defines at least one rectangular support panel 32 having mutually parallel top and bottom edges 34 and 36, respectively, and mutually parallel inner and outer lateral edges 38 and 40, respectively. The lateral edges 38 and 40 are oriented perpendicular to the top and bottom edges 34 and 36.

The flat sheet 30 also defines a pair of generally rectangular pocket panels 42 and 44. The first pocket panel 42 is formed as a projecting extension from the bottom edge 36 of the support panel 32. The other pocket panel 44 is formed as a laterally projecting extension from the first pocket panel 42. A fold line 46 which is collinear with the laterally outer edge 40 of the support panel 32 delineates the two pocket panels 42 and 44 from each other.

The pocket panels 42 and 44 both have fastening flaps. Specifically, the first pocket panel 42 has a narrow, marginal fastening flap 48 that projects laterally beyond the lateral inner edge 38 of the support panel 32 prior to folding the sheet 30. The other pocket panel 44 also includes a narrow, laterally projecting marginal fastening flap 50, and a narrow, vertically projecting fastening flap 52. Each of the folding flaps 48, 50, and 52 is formed as a narrow, trapezoidal-shaped strip extending away from the structure of the pocket panel with which it is associated.

In fabricating the folder insert 12, the exposed surfaces of the fastening flaps 48, 50, and 52 are coated with an adhesive. The exposed surfaces are those surfaces on the faces of the fastening flaps 48, 50, and 52 which are visible in FIG. 1A. The fastening flaps 48, 50, and 52 are thereupon folded inwardly toward the pocket panels 42 and 44 25 with which they are associated along the fold lines indicated at 48', 50', and 52', in the directions indicated by the directional arrows 54, 56, and 58.

Figure 1B:
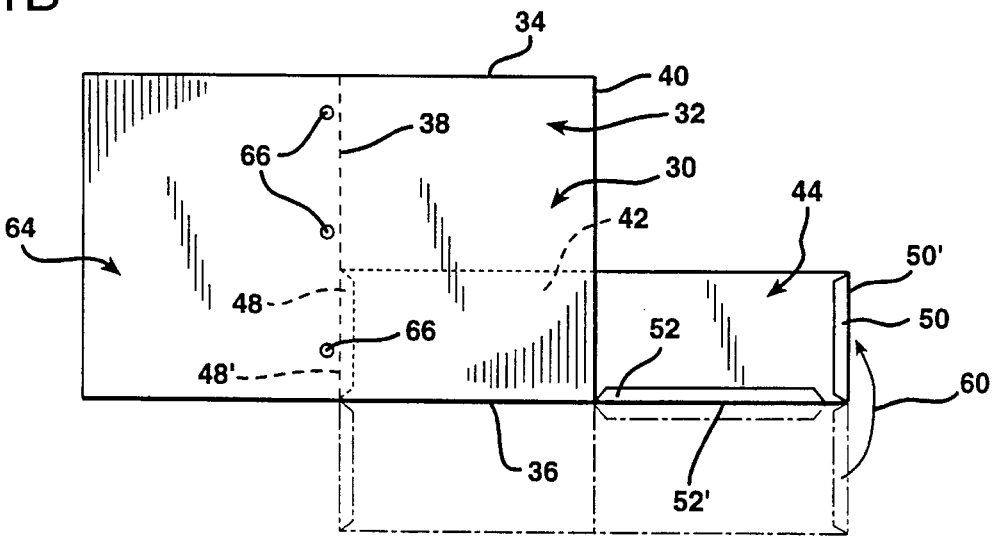
FIG. 1B illustrates the initial steps of folding the sheet of material of FIG. 1A in forming the folder insert depicted in FIG. 1.

The first pocket panel 42 is then folded upwardly in behind the lower portion of the support panel 32 in the manner illustrated in FIG. 1B. When the pocket panel 42 is folded in this fashion, it carries with it the other pocket panel 44, which is brought upwardly adjacent the outer lateral edge 40 of the support panel 32, also as shown in FIG. 1B. The pocket panels 42 and 44 are folded upwardly as indicated by the directional arrow 60.

In the intermediate condition of FIG. 1B, the adhesive coated sides of the fastening flaps 50 and 52 are visible beyond the outer lateral edge 40 of the support panel 30. At this point the adhesive coated surface of the fastening flap 48 is pressed against and thereby secured to the back face of the support panel 32 immediately adjacent to he inner lateral edge 38 thereof.

Figure 1C:
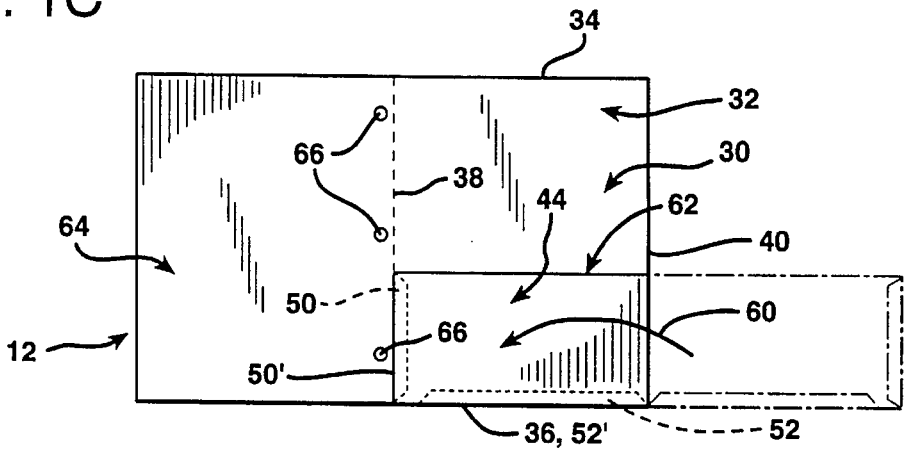
FIG. 1C illustrates the further steps of forming the folder insert employed in the folder of FIG. 1.

To complete the formation of the folder insert 12, the pocket panel 44 is swung forward and to he left, as indicated by the directional arrow 60 in FIG. 1C, so that the adhesive coated surfaces of the fastening flaps 50 and 52 are brought into contact with and adhere to the front face of the support panel 32. The lateral fastening flap 50 is adhesively secured to the front face of the support panel 42 immediately adjacent to the inner lateral edge 38 thereof. The adhesive coated surface of the fastening flap 52 is pressed against and adhesively secured to the front face of the support panel 32 immediately adjacent to the lower edge 36 thereof. Fabrication of the folder insert 12 is thereupon complete.

When construction of the holder insert 12 has been completed as shown in FIG. 1C, the pocket panels 42 and 44 both have their respective fastening flaps 48 and 50, 52 folded back between the respective pocket panels 42 and 44 and he support panel 32. That is, in he assembled condition of FIG. 1C the fastening flap 48 resides between he structures of the pocket panel 42 and the support panel 32 and is adhesively secured to the support panel 32. Likewise, the fastening flaps 50 and 52 reside between the structure of he pocket panel 44 and the support panel 32 with he fastening flaps 50 and 52 being adhesively secured the support panel 32.

In this way the pocket panels 42 and 44, and the support panel 32 form a pair of pockets 62. One of the pockets 62 is defined between the pocket panel 42 and he support panel 32, while the other pocket 62 is defined between the pocket panel 44 and the support panel 32.

The single stiff paper or card stock sheet 30 also defines a folder attachment flap 64, shown to the left of the support panel 32 in FIGS. 1 through 1C. The folder attachment flap 64 is a wide, expansive, rectangular structure substantially the same size as the support panel 32. The folder attachment flap 64 serves as a folio attachment flap and extends from the interior lateral edge 38 of the support panel 32. As illustrated in FIG. 1, the folio attachment flap 64 may be readily inserted laterally from the side into the side opening pocket formed between the front cover pocket panel 20 and the front cover 16. The folio attachment flap 64 thereby serves as a means for attaching the folder insert 12 to the folio 10.

It should be noted that he attachment flap 64 is perforated by three small apertures 66 spaced longitudinally along one side of the attachment flap 64 proximate the demarcation with the support panel 32 formed by the laterally interior edge 38 thereof. The apertures 66 are preferably spaced longitudinally four and one-quarter inches apart center-to-center. The apertures 66 ace all preferably either one-quarter inch or five-sixteenths of an inch in diameter, and are preferably spaced from the edge 38 a distance of about thee-eighths of an inch, when measured from the centers of the apertures 66 to the edge 38 of the support panel 32.

Figure 1D:
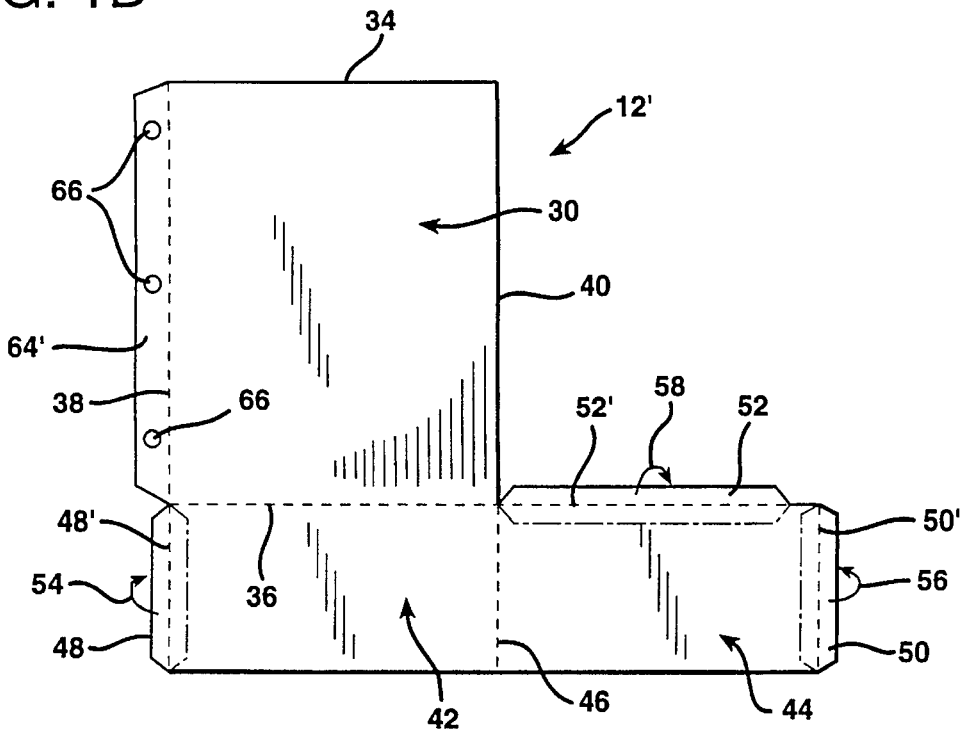
FIG. 1D illustrates an alternative embodiment of a folder insert, prior to folding, that can be utilized in place of he folder insert depicted in FIG. 1.

The punching of the attachment flap 64 in this manner allows the folder insert 12 to be utilized either in its original configuration, depicted in FIGS. 1–1C, or to be modified to a folder insert 12', depicted in FIG. 1D That is, since the apertures 66 exist near the interior margin of the attachment flap 64, the attachment flap 64 can be cut down from the size illustrated in FIG. 1–1C to a truncated form wherein only a narrow, longitudinal strip 64' remains as shown in FIG. 1D. When the folder insert 12 is cut down to form the folder insert 12', a structure is created which can be used in binders other than bifolding folios. Specifically, the folder insert 12' is readily adaptable for insertion into ring and prong binder folios by virtue of the perforations 66 in the attachment flap 64'. The size and spacings of the apertures 66 ensure that the folder insert 12' can be utilized with conventional, commercially available ring and prong binders.

The folder insert 12' depicted in FIG. 1D is similar in all respect to the folder insert 12 with the exception that the attachment flap 64' is a much narrower, cut-down version of the attachment flap 64.

Figure 1E:
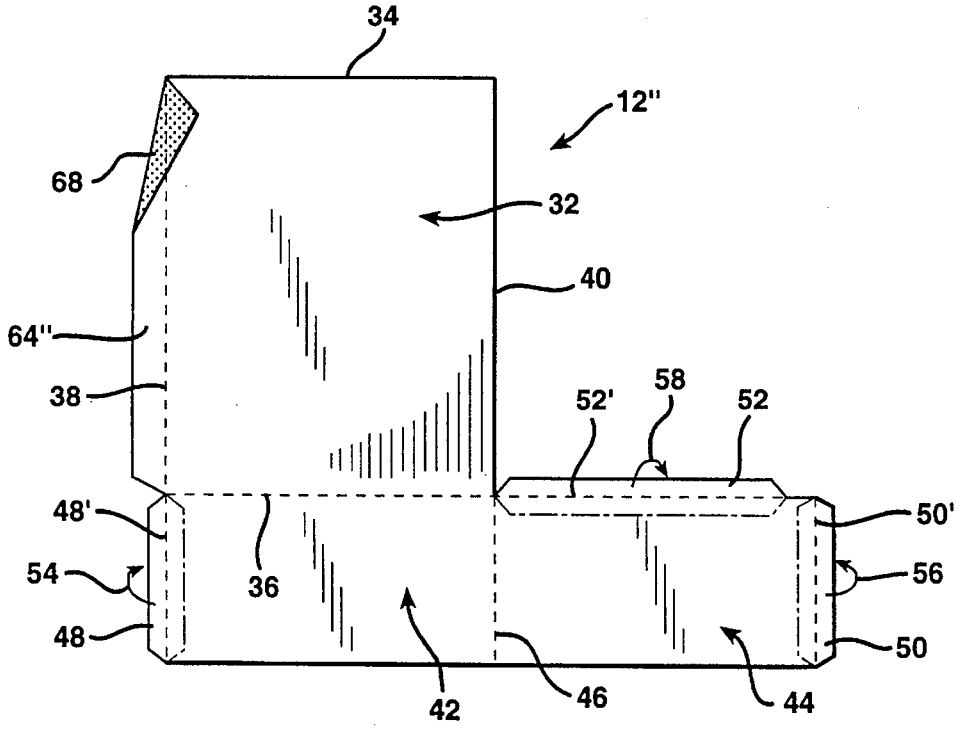
FIG. 1E illustrates still another embodiment of a folder insert, prior to folding, that can be employed in place of the folder insert shown in FIG. 1.

FIG. 1E illustrates a further variation of the folder insert 12'. Specifically, the folder insert 12" illustrated in FIG. 1E, like the folder insert 12', includes an attachment flap 64' which is only a narrow, longitudinal strip projecting laterally from the edge 38 of the support panel 32. Unlike the attachment flap 64' the attachment flap 64" is not perforated with apertures 66 but rather is coated on one side with an adhesive coating indicated at 68 in FIG. 1E. The adhesive coating 68 may be initially covered by a release strip and removed to allow attachment of the flap 64' to the inside surface of either the front cover 16 or the back cover 18 of the folio 10.

Figure 2:
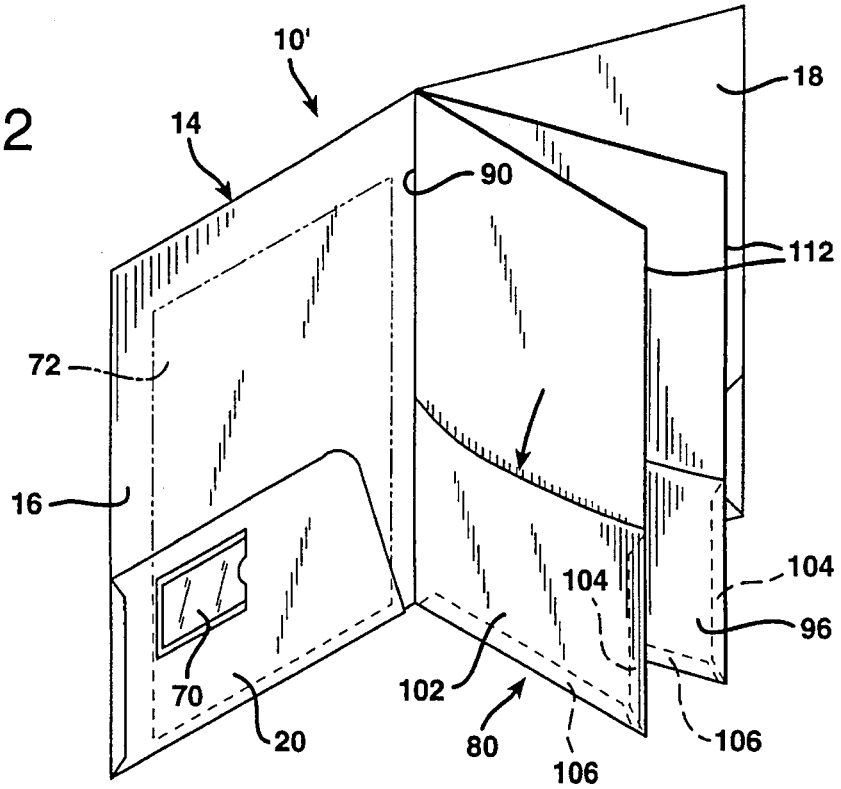
FIG. 2 is a perspective view illustrating an alternative embodiment of an improved folder and folder insert according to the invention.

FIG. 2 illustrates another folio folder 10' which is very similar to the folio folder 10. The only difference between the folio folder 10 and the folio folder 10' is that the folio folder 10' includes a transparent business card or identification card pocket 70 attached to the outside surface of the front cover pocket panel 20. Also, the front cover 16 includes on its outer, exposed surface a large, transparent front pocket 72, formed of Mylar plastic and arranged to receive a title page, a table of contents, or other useful printed material removably positionable therewithin.

Figure 2A:
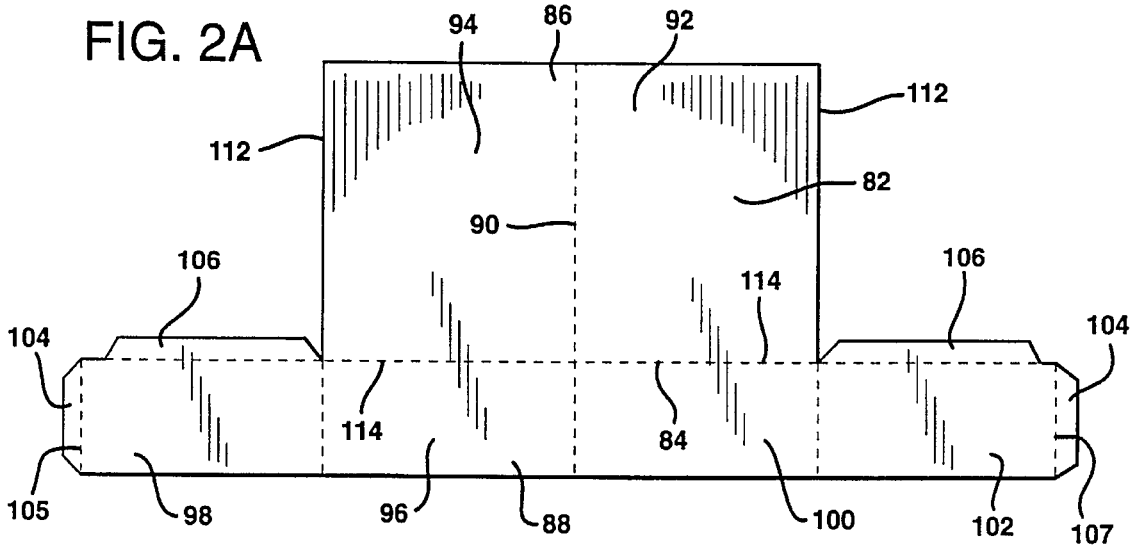
FIG. 2A is a plan view of a flat sheet of material, prior to folding, that is used to form the folder insert depicted in FIG. 2.
Figure 2B:
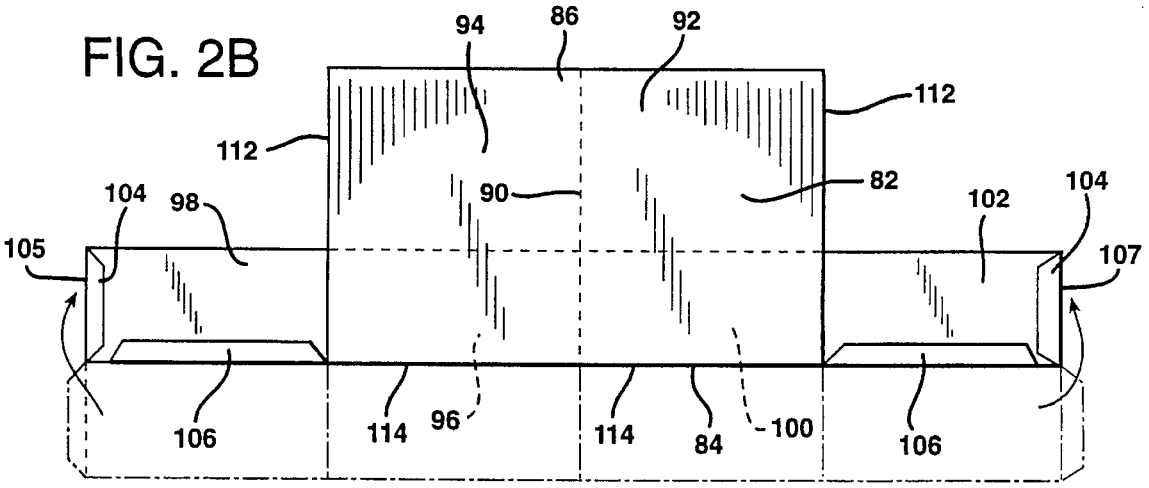
FIG. 2B is a plan view illustrating the initial steps of folding the sheet of material of FIG. 2A to form the folder insert shown in FIG. 2.
Figure 2C:
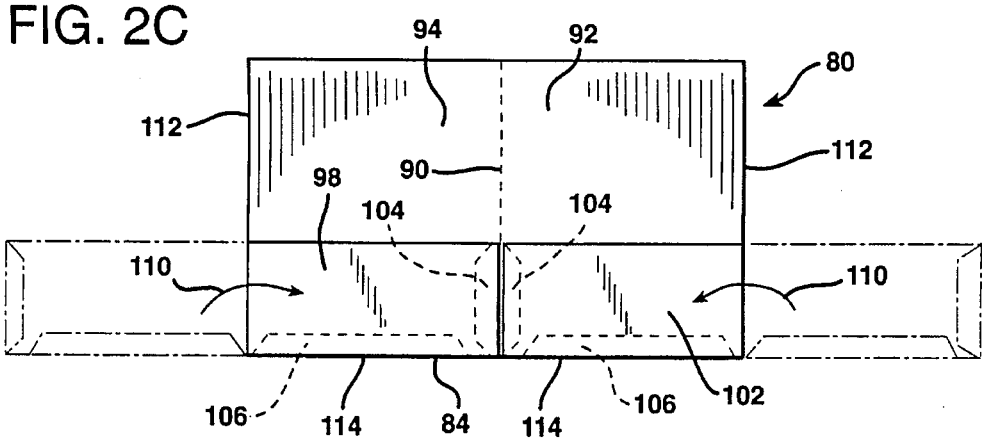
FIG. 2C is a plan view illustrating the further steps of forming the folder insert shown in FIG. 2.

The folio folder 10' includes a folio insert 80 having a somewhat different construction than the folio inserts 12, 12', and 12", hereinbefore described The construction of the folder insert 80 is depicted in FIGS. 2A, 2B, and 2C.

As shown in FIG. 2A, the folder insert 80 is initially formed of a single, flat, stiff sheet 82 of card or paper stock. The sheet 82 has a linear, transverse fold 84 thereacross to delineate support and pocket sections of the sheet 82. Specifically, the rectangular support section 86 is located above the linear fold 84, while he elongated pocket section 88 is located below he transverse fold 84.

The sheet 82 also includes a linear, longitudinal bifurcating fold 90 ha is oriented perpendicular to the transverse fold 84. The longitudinal fold 90 bifurcates the support section 86 into two laterally adjacent support panels 92 and 94. The longitudinal fold 90 also bifurcates the pocket section 88 into two pairs of pocket panels. The first pair of pocket panels includes the pocket panel 96 and pocket 98, while he second pair of pocket panels includes the pocket panels 100 and 102.

The pocket panels 98 and 102 are each provided with a laterally outwardly projecting fastening flap 104 and an orthogonal fastening flap 106. The fastening flaps 106 are delineated from the pocket panels 98 and 102 by the extended transverse fold line 84. The outwardly projecting fastening flaps 104 are delineated from the pocket panels 98 and 102 by fold lines 105 and 107, respectively.

As is evident from FIG. 2A, the pocket panels 96 and 100 are both formed as projecting extensions from the bottom edges 114 of the support panels 92 and 94 from which they extend. The other panels 98 and 102 are formed as projecting extensions from the outside lateral edges of he support panels 96 and 100, respectively.

The longitudinal fold line 90 bifurcates the sheet 82 to form a pair of support panels 92 and 94, each of which has a separate pair of pocket panels defining pockets at both opposite faces of the support panels 92 and 94. The single flat sheet 82 thereby is able to create a folder insert 80 that has four additional pockets for receiving and organizing papers within the folio folder 10'.

To construct the folder insert 80 the sheet 82 is first folded along the transverse fold line 84 as depicted in FIG. 2B. The pocket section 96 is folded up behind the support section 92 as illustrated in FIG. 2B. The fastening flaps 104 and 106 are then folded inwardly back against the structure of the pocket panels 98 and 102 from which they extend. The exposed surfaces of the fastening flaps 104 and 106 that are thereupon visible in FIG. 2B are then coated with adhesive.

The pocket panels 98 and 102 are then folded forwardly and inwardly as indicated in FIG. 2C by the directional arrows 110 toward the longitudinal bifurcating fold line 90. This folding action brings the structure of the pocket sections 96 and 100 out around the outer lateral edges 112 of the support panels 92 and 94. The adhesive coated surfaces of the fastening flaps 104 and 106 are thereupon pressed against the lower portion of the front faces of the support panels 92 and 94 as illustrated in FIG. 2C. The fastening flaps 106 are hereupon secured by adhesive to the outwardly facing surfaces of the support panels 92 and 94 immediately adjacent the bottom edges 114 thereof, while the fastening flaps 104 are secured by adhesive to the same faces of the support panels 92 and 94 immediately adjacent the longitudinal fold line 90 which forms the laterally interior edges of both of he support panels 92 and 94 and which delineates the support panels 92 and 94 from each other.

The support panels 92 and 94 are then folded toward each other to form the folder insert 80 illustrated in FIG. 2. The folder insert 80 is thereupon attached to the folio folder 10' by staples, for example, which may be spaced longitudinally as required along the central longitudinal fold line 90. The staples hold the folder insert 80 in contact with the folio folder 10' at the demarcation between the front and back covets 16 and 18 of the folio folder 10', and also at the demarcation between the support sections 92 and 94 of the folder insert 80.

From the illustrations of FIGS. 2 through 2C it is apparent that each support panel 92 and 94 is provided with a pocket each of its opposite faces. That is, the support panel 92 is provided with a pocket on one side formed by the pocket panel 100 and a pocket on the opposite side formed by the pocket panel 102. Similarly, the support panel 94 has a pocket on one side formed by the pocket panel 96 and a pocket on its opposite side formed by the pocket panel 98. Each of the pocket panels 96, 98, 100, and 102 is folded to reside against a different one of the faces of the two support panels 92 and 94.

While the folio folder 10' has been shown with but a single folder insert 80 attached thereto, it should be understood that any number of folder insets 80 could be inserted into the folio folder 10'. That is, each successive folder insert 80 can be opened to the condition shown in FIG. 2C and nested within the preceding folder insert 80. The folders 80 are pressed against each other and secured to the folio folder 10' along their mutually adjacent longitudinal fold line 90. Thus, the capacity of the folio folder 10' can be expanded by the addition of four, eight, twelve, or even more pockets by the insertion therein of one, two, three, or more folder inserts 80.

Figure 2D:
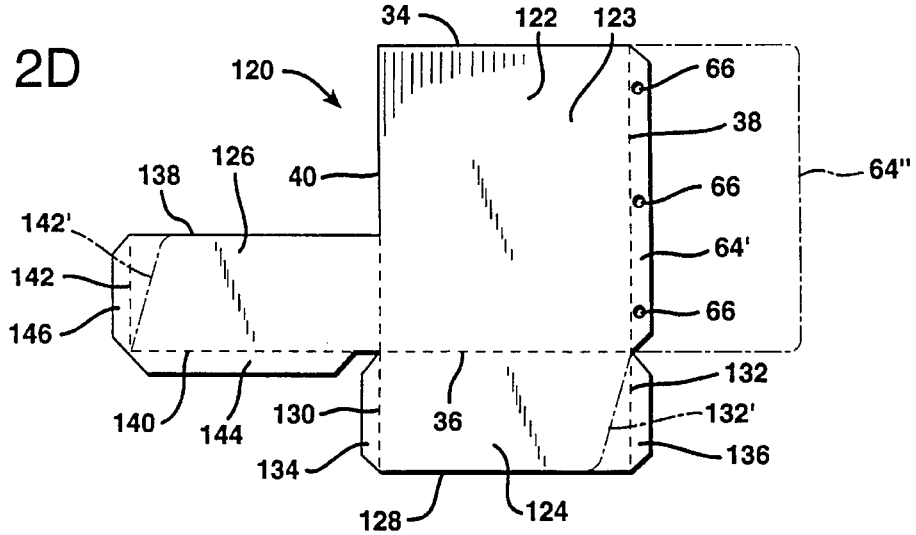
FIG. 2D is a plan view of a sheet of material that may be utilized to form an alternative embodiment of a folder insert according to the invention.

FIG. 2D illustrates another embodiment of a folder insert 120 according to the invention. Like the folder insert 12', depicted in FIG. 1D, the folder insert 120 is formed of a single sheet of flat card stock 122 forming a rectangular support panel 123 having a bottom edge 36 parallel to the top edge 34, and lateral side edges 38 and 40 oriented perpendicular to the top and bottom edges 34 and 36. The folder insert 120 includes a pair of pocket panels 124 and 126. The first pocket panel 124 is formed as a projecting extension from the lower edge 36 of the rectangular support panel 123. The first pocket panel 124 has an edge 128 that forms the mouth of the pocket, and lateral side edges 130 and 132 perpendicular to the edges 36 and 128. Fastening flaps 134 and 136 extend laterally outwardly from the pocket panel 124 beyond he lateral edges 130 and 132 thereof.

The second pocket panel 126 is formed as a laterally projecting extension from the lower portion of the lateral edge 40 of the support panel 123. The second pocket panel 126 likewise has a rectangular configuration and is bounded at its top by an edge 138 that forms a mouth of a pocket and at its bottom by an edge 140. The second pocket panel 126 shares one common lateral edge with the lower portion of the lateral edge 40 of the support panel 123. The other lateral edge 142 of the second pocket panel 126 is parallel to the edge 40. A lower fastening flap 144 projects from the lower edge 140 of the pocket panel 126 as a narrow, marginal strip while another narrow, marginal strip 146 of the sheet 122 projects laterally from the edge 142.

To assemble the folder insert 120, the surfaces of the fastening flaps 144 and 146 that are visible in FIG. 2D are coated with an adhesive and the sheet 122 is then folded along the edges 140 and 142 to bring the fastening flaps 144 and 146 in behind the pocket flap 126. When the fastening flaps 144 and 146 are folded in this manner the uncoated surfaces of the fastening flaps 144 and 146 are folded back against and into contact with the back side of pocket panel 126 as viewed in FIG. 2D. The sheet 122 is then folded along the lateral edge 40, thereby swinging the pocket panel 126 rearwardly in rotation about the edge 40 in behind the support panel 123 as viewed in FIG. 2D. The adhesive coated surfaces of the fastening flaps 144 and 146 are thereupon pressed against the back face of the support panel 123. The fastening flap 144 is thereby secured to the lower portion of the back face of the support panel 123 immediately adjacent the bottom edge 36 thereof. The adhesive coated surface of the fastening flap 146 is pressed against the back face of the support panel 123 immediately adjacent to the lower portion of the lateral edge 38 of the support panel 123. The pocket panel edge 142 thereupon resides immediately adjacent to the lower portion of the edge 38 of the support panel 123, while the bottom edge 140 of the pocket panel 126 resides immediately adjacent to the bottom 36 of the support panel 123.

The fastening flaps 134 and 136 are thereupon each coated on one side with adhesive and folded forwardly and inwardly as viewed in FIG. 2D, so that the uncoated sides thereof reside in contact with the surfaces of the pocket panel 124 that are visible in FIG. 2D. The pocket panel 124 is then folded upwardly in rotation about the lower edge 36 of the support panel 123 and pressed against the lower portion of the support panel 123. The adhesive coated surfaces of the fastening flaps 134 and 136 thereupon adhere to the face of the support panel 123 that is visible in FIG. 2D immediately adjacent to he lower portions of the lateral edges 40 and 38 thereof, respectively. When he pocket panel 124 is folded in this manner, the lateral edges 130 and 132 thereof reside immediately adjacent to he lower portions of the lateral edges 40 and 38, respectively, of the support panel 123.

When the sheet 122 has been folded in this manner, the fastening flaps 134, 136, 144, and 146 are all folded back between the pocket panels from which he extend, respectively, and the support panel 123. The fastening flaps 124 and 126 are thereby secured to the support panel 123 to form upwardly opening pockets at both of the opposite faces of the support panel 123.

The folder insert 120 also includes a fastening flap 64' formed as a marginal strip along the lateral edge 38 of the support panel 123. The narrow fastening flap 64' is punched with apertures 66 the same as on the folder insert 12' shown in FIG. 1D, and is used in the same manner.

It should be understood that various modifications can be made to the folder insert 120. For example, the fastening flap 64' can be extended laterally to a much greater extent, as indicated in phantom at 64". A fastening flap of this type can either be inserted into a pocket on one of the inside covers of a folio folder, in the matter depicted in FIG. 1, or it can be coated with adhesive and pressed against and adhesively secured to the inside surface of either the front or back cover of a folder.

The pockets formed by the pocket panels 124 and 126 with the support panel 123 in the folder insert 120 are all closed at the bottom and on both lateral edges, and are open at the top. This arrangement laterally confines papers inserted into the pocket and prevents papers and other materials from falling out of the pocket through the bottom.

In an alternative arrangement, the pockets formed by the pocket panels 124 and 126 can each be open on one side. With this arrangement, the pocket panels 124 and 126 may be configured in a generally trapezoidal shape, whereby a lateral edge 132' of the pocket panel 124, shown in phantom in FIG. 2D, is inclined relative to the edges 36 and 128 and a lateral edge 142' of the pocket panel 126 is inclined relative to the edges 138 and 140. With this arrangement the fastening flaps 136 and 146 are omitted so that the pocket is open at both the top and adjacent the lateral inside edge 38 of the support panel 123. Such an arrangement facilitates the insertion and removal of papers from the pockets so formed.

Figure 2E:
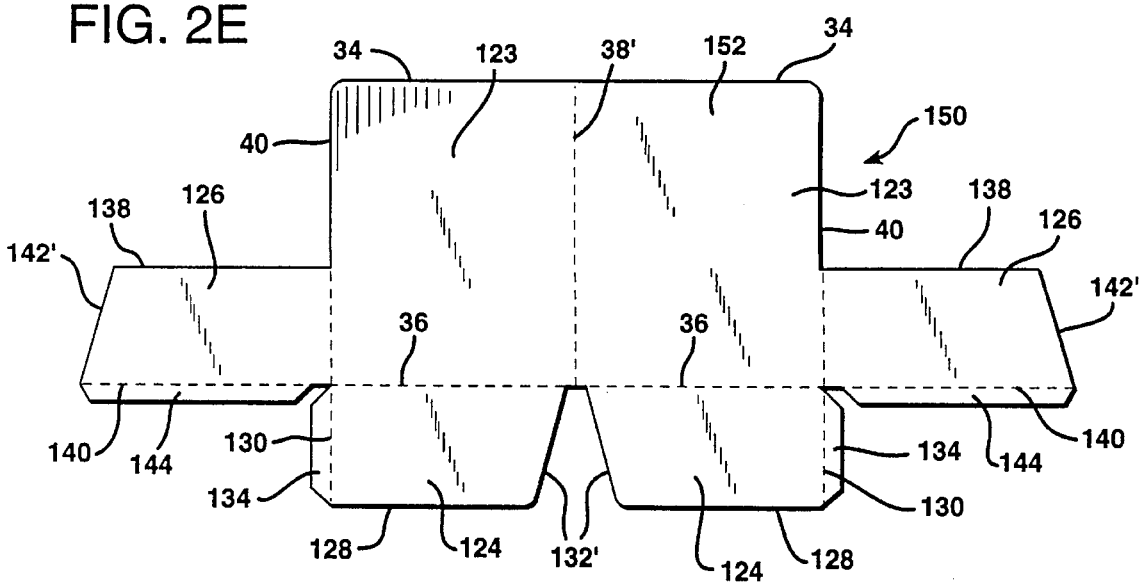
FIG. 2E is a plan view showing a sheet of flat material, prior to folding, that forms still another embodiment of a folder insert according to the invention.

FIG. 2E illustrates still another embodiment of the invention. The folder insert 150, like the other embodiments shown, is formed of a single sheet of stiff paper or card stock 152. The sheet 152 is bifurcated by a longitudinal, central fold line 38'. The sheet 152 is thereby configured to form a pair of support panels 123 and pocket panels 124 and 126 in mirror image arrangement. Each portion of the folder insert 150 on the opposite lateral sides of the longitudinal, bifurcating fold line 38' provides the same structure depicted and described in connection with FIG. 2D. Thus, rather than providing a single support panel 123 and a single pair of pocket panels 124 and 126, the folder insert 150 provides a pair of support panels 123 and a pair of pocket panels 124 and 126 projecting from each one of the support panels 123. Each portion of the folder insert 150 on the opposite sides of the bifurcating fold line 38' is constructed as depicted and described in the embodiment of FIG. 2D. The folder insert 150 is utilized in the same manner as the folder insert 80 shown in FIG. 2.

Figure 2F:
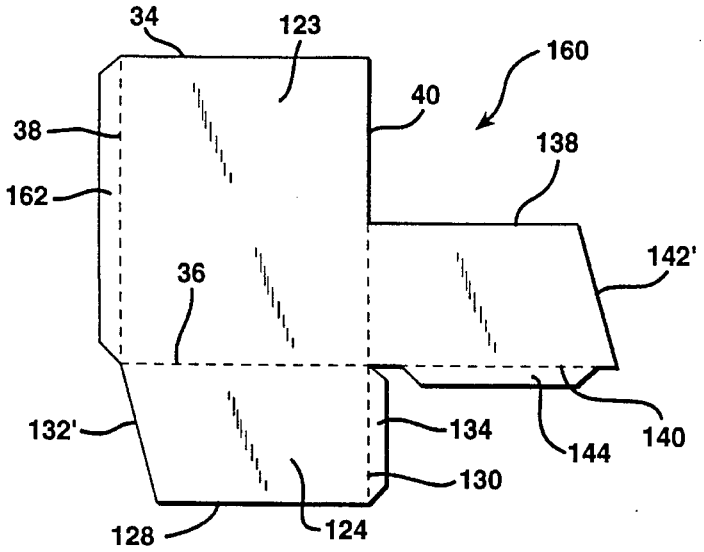
FIG. 2F is a plan view of a sheet of flat material, shown prior to folding that is used to form still another embodiment of a folder insert according to the invention.

FIG. 2F illustrates another embodiment of a folder insert 160 which is similar in many respects to the folder insert 120 shown in FIG. 2D. The elements and components of the folder insert 160 that find corresponding structure in the folder insert 120 are labelled with the same reference numbers used in FIG. 2D.

The difference between the folder insert 160 and the folder insert 120 is that the folder insert 160 employs an unperforated, narrow fastening flap 162 that extends the length of the support panel 123 along the edge 38 thereof. The fastening flap 162 is not perforated, but instead is coated with a pressure-sensitive adhesive, initially covered by a protective release strip. The folder insert 160 can be attached to a folio folder of the type shown in either FIG. 1 or FIG. 2 by removing the release strip and pressing the adhesive coated surface of the fastening flap 162 against the inside surface of either the front or back cover, immediately adjacent the demarcation therebetween. That is, the edge 38 of the folder insert 160 so formed resides in alignment with and immediately adjacent to the longitudinal demarcation between the front cover 16 and the back cover 18 of a folio folder 10 or 10'. Once inserted into a folio folder 10 or 10' the folder insert 160 functions in the same manner as the folder inset 12 shown in FIG. 1.

Figure 2G:
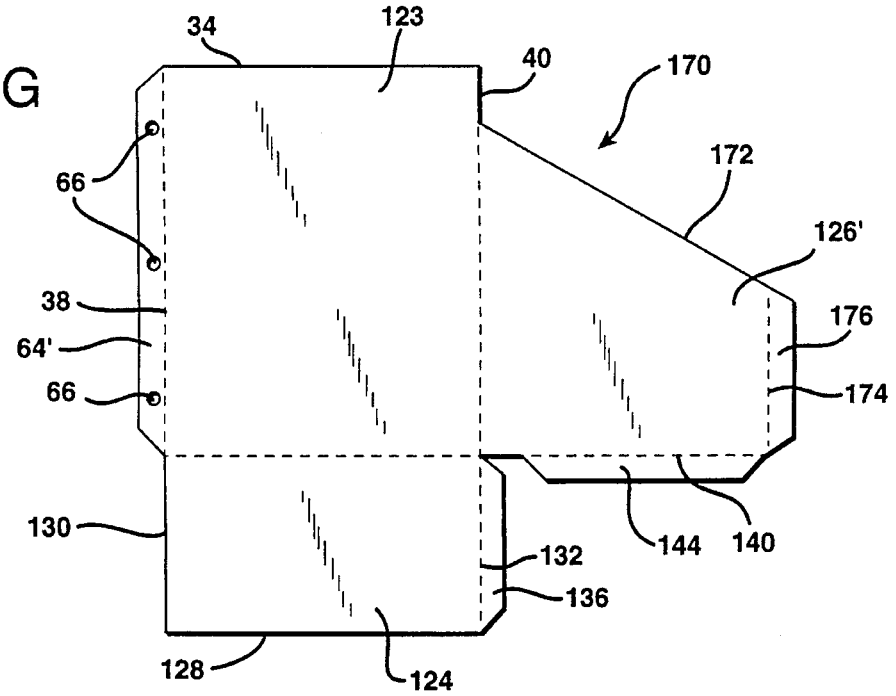
FIG. 2G is a plan view of a sheet of flat material shown prior to folding that is used to form still another embodiment of a folder insert according to the invention.

FIG. 2G illustrates another folder insert 170 according to the invention. The folder insert 170 is similar in many respects to the folder insert 120, and elements and components common thereto bear the same reference numbers.

The folder insert 170 differs from the folder insert 120 in that there is no fastening flap extending laterally from the lateral edge 130. The pocket formed between the pocket panel 124 and the back surface of the support panel 123 is open at both the top edge 128 and at the lateral, inside edge 130 of the pocket panel 124. In addition, the upper edge 172 of the pocket panel 126' is not parallel to the bottom edge 140 thereof, but rather is oriented at a marked inclination relative thereto and relative to the lateral edge 40 of the support panel 123. The lateral, outside edge 174 of the pocket panel 126' is parallel to the edge 40. Unlike the pocket formed by the pocket panel 124, the pocket formed by the pocket panel 126' is closed not only at the bottom along the edge 140 by the fastening flap 144, but also along its inside, longitudinal edge by means of the fastening flap 176.

Figure 2H:
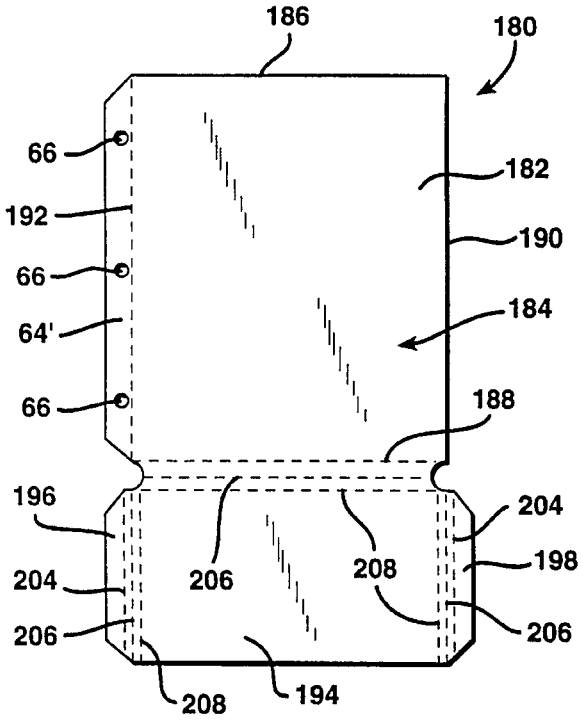
FIG. 2H is a plan view of a sheet of material, prior to folding, used to form still a further embodiment of a folder insert according to the invention.
Figure 2I:
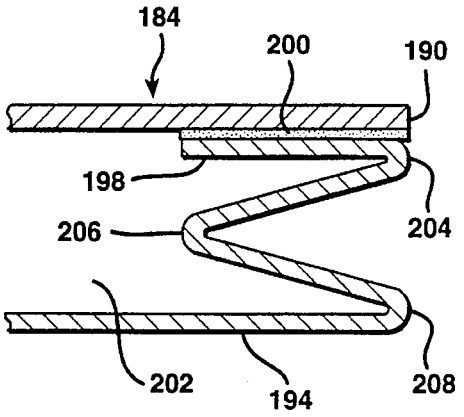
FIG. 2I is a cross-sectional detail illustrating a portion of a folder insert formed from the sheet of material depicted in FIG. 2H.

Still another embodiment of the invention is depicted in FIGS. 2H and 2I. FIG. 2H illustrates a folder insert 180 comprised of a single sheet 182 of stiff, flat card or paper stock folded to form at least one rectangular support panel 184 and having a top edge 186 and a bottom edge 188. The top and bottom edges 186 and 188 are mutually parallel to each other. The sheet 182 also defines mutually parallel lateral edges 190 and 192 which are oriented perpendicular to the top and bottom edges 186 and 188.

The folder insert 180 has a single pocket panel 194 of rectangular configuration. The pocket panel 194 has fastening flaps 196 and 198 projecting laterally from its opposite sides. The fastening flaps 196 and 198 are folded back between the pocket panel 194 and the support panel 184, as illustrated in FIG. 2I. The opposite surfaces of the fastening flaps 196 and 198 from those visible in FIG. 2H are coated with a layer of adhesive, indicated at 200 in FIG. 2I, and pressed against the front face of the support panel 184 adjacent the opposing lateral edges 190 and 192 thereof. The fastening flaps 196 and 198 are thereby secured to the support panel 184 by layers of adhesive 200. The pocket panel 194 is folded across the lower portion of the support panel 184 and anchored thereto by its integral connection to the bottom edge 188 and along both of the lateral edges 190 and 192. A pocket 202 is thereby formed between the support panel 184 and the pocket panel 194.

As shown in FIG. 2I the pocket panel 194 and the fastening flaps 196 and 198 are provided with accordion folds 204, 206, and 208. The accordion folds 204–208 permit expansion of the panel so that the thickness of the pocket 202 can be increased o decreased, as appropriate to receive the papers to be inserted therein.

The sheet of card stock 182 is also formed with a folder attachment flap 64' that is formed as a narrow strip of the sheet 182 projecting laterally beyond the lateral edge 192 of the support panel 184. The folder attachment flap 64' may be secured in a ring binder, by virtue of the apertures 66, or it may be coated with adhesive and secured to the inside surface of either front cover 16 or the back cover 18 of one of the folios 10 or 10' shown in FIGS. 1 and 2.

Figure 3:
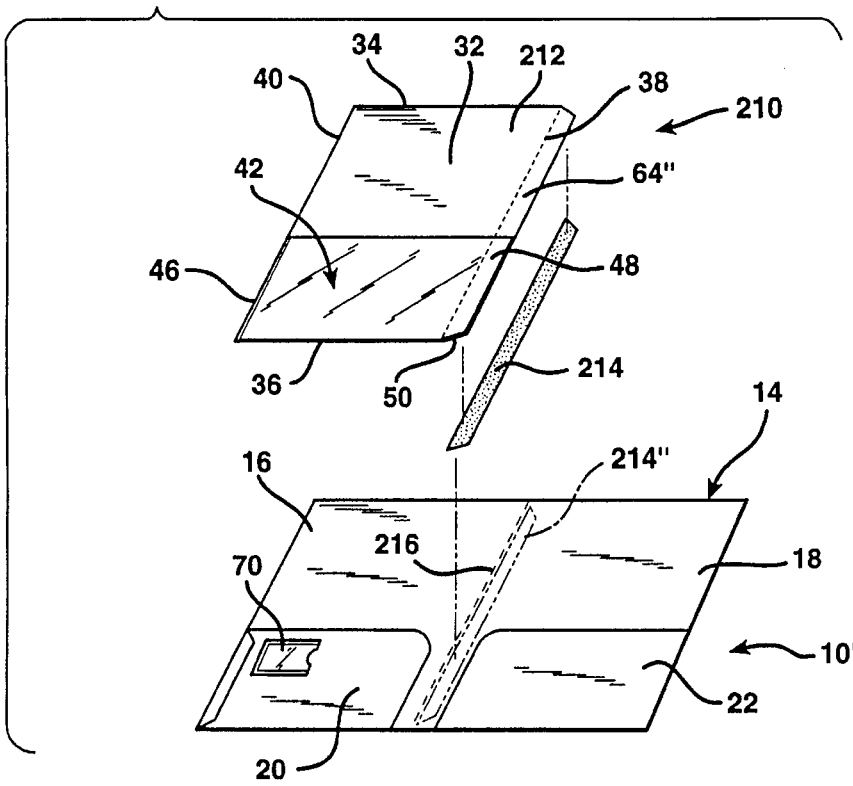
FIG. 3 is an exploded perspective view illustrating still a further embodiment of the invention prior to assembly.
Figure 3A:
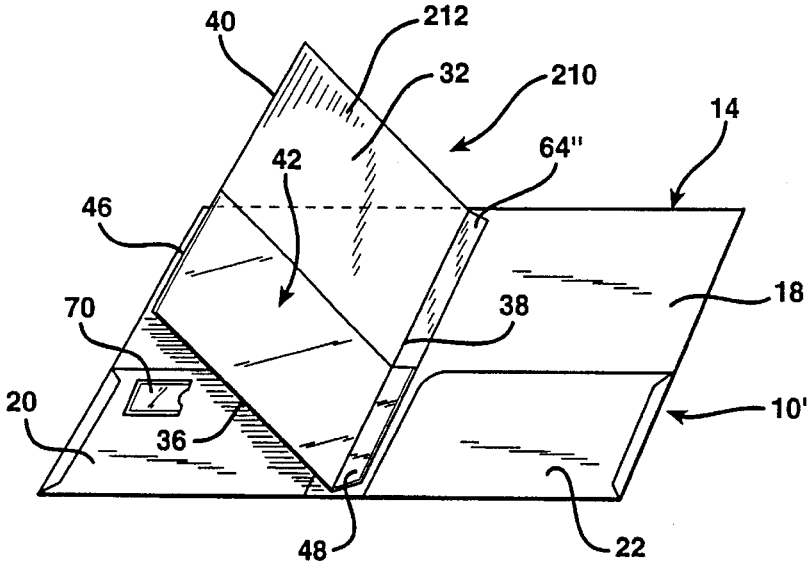
FIG. 3A illustrates the folder and folder insert of FIG. 3 assembled together.

FIGS. 3 and 3A illustrate another alternative embodiment of the invention in which the folder insert 210 is not formed of a sheet of heavy paper or card stock, but rather is formed of a sheet of transparent plastic material, such as vinyl or acetate. The sheet 212 forming the folder insect 210 is initially the same shape as the sheet forming the folder insert 12" depicted in FIG. 1E with the exception that it does not employ the flap 52 on the pocket panel 44. Also, the flaps 50 and 48 are not folded under, as in the embodiment depicted in FIG. 1E, but rather reside in contact with the opposite surfaces of the lower portion of the attachment flap 64".

To close the pockets formed from the plastic sheet 212, the pocket panels 42 and 44 are heat sealed, or adhesively sealed to the support panel 32 immediately adjacent to the bottom and lateral edges 36 and 40 thereof. Also, the extension flaps 48 and 50 are not folded under, but extend out over and in contact with the opposite surfaces of the lower portion of the fastening flap 64" and are heat sealed or fused thereto.

In the embodiment shown in FIGS. 3 and 3A the folder inset 210 is secured to the folio folder 10' by means of a fastening strip 214 which is a long, narrow strip having a shape congruent to that of the fastening flap 64". The strip 214 is coated on both sides with a pressure-sensitive adhesive. To secure the folder insert 210 to the folio folder 10', the release agent coated protector sheet on one side of the strip 214 is removed and the strip 214 is pressed against the exposed surfaces of the upper portion of the fastening flap 64" and the attachment flap 50 as illustrated in FIG. 3.

The release agent coated protector sheet is then removed form the underside of the strip 214 and the folder insert 210 with the strip 214 therebeneath is then pressed downwardly against the folio folder 10'. The adhesive coating on the underside of the strip 214 makes contact with the inside surface of the back cove 18 of the folio folder 10' immediately adjacent to the central, longitudinal fold 216 in the folio folder 10'. The longitudinal fold 216 delineates the front cover 16 from the back cover 18 of the folio folder 10'. The folder insert 210 thereupon becomes firmly attached to and thereafter comprises a permanent part of the folio folder 10'.

The folder insert 210 thereby provides two additional pockets to expand the capacity of the folio folder 10'. Moreover, any number of additional folder inserts 210 can be inserted and attached to the folio folder 10' in the same manner, he fastening flaps 64" thereof residing one atop another. Alternatively, some of the fastening flaps 64" can be attached to the inside of the font cover 16 immediately adjacent the demarcation fold 216.

Many other variations and modifications of the invention are also possible. For example, the fastening flap 64" in the embodiments of FIGS. 3 and 3A can be fused or heat sealed to the inside of the folio folder 10' along he fold 216 thereof if he folio folder 10' is formed of a compatible plastic. Alternatively, he fastening flap 64" can be glued directly to the inside of he folio folder 10' by applying a layer of curable adhesive longitudinally to the inside surface of either the front cover 16 or the back cover 18 adjacent the demarcation fold 216. For example, he adhesive can be applied from a squeezable tube or by utilizing a brush in the area indicated at 214" in FIG. 3. In this case he attachment flap 64", together with the foldable flap 50 can be pressed directly onto the adhesive without the use of an intermediate adhesive coated strip 214.

Numerous other modifications of the invention are also possible. Any of the fastening flaps illustrated in the different embodiments may be secured by staples, glue, rivets, fusion welds, or any other conventional fastening means to create a secure attachment to a folder, as well as removable attachments through the apertures 66. Also, numerous other types of folders may be substituted for the folio folders 10 and 10' depicted. In addition, fastening flaps and folding flaps of many different configurations may be utilized. Accordingly, the scope of the invention should not be construed as limited to the specific embodiments depicted and described herein.

I claim:

1. In a folder including a folio folded to form front and back covers wherein said folio is formed with at least one folio pocket on the inside of at least one of said front and back covers, the improvement comprising a folder insert formed of a single sheet of flat material folded to delineate at least one rectangular support panel having opposing flat surfaces and bounded by mutually parallel top and bottom edges and mutually parallel lateral edges aligned perpendicular to said top and bottom edges, and further folded to delineate at least one pair of pocket panels extending across both said opposing flat surfaces and held thereto at said bottom edge and along at least one of said lateral edges of said at least one support panel, wherein said at least one support panel is interposed between said pocket panels in said at least one pair of pocket panels, which together with said at least one support panel form separate pockets with both said flat surfaces of said at least one support panel, and wherein said single sheet of flat material also forms a folio attachment flap as an extension from one of said lateral edges of said support panel, and said folio attachment flap is formed as an expansive lateral extension from said support panel and is received within said folio pocket.

2. A folder insert comprised of a single sheet of flat stock bifurcated by a longitudinal fold and said single sheet is further folded to form a pair of support panels each having opposing faces and each having mutually parallel top and bottom edges and mutually parallel lateral edges oriented perpendicular to said top and bottom edges, and to form two pairs of pocket panels, a separate pair of said pocket panels being folded across portions of each of said support panels, whereby a separate pocket panel is disposed against each of said opposing faces of said support panels and is anchored thereto along said bottom edge thereof and along at least one of said lateral edges thereof.

3. A folder insert comprised of a single sheet of flat stock which has a linear, transverse fold thereacross to delineate support and pocket sections above and below said transverse fold, respectively, and a linear longitudinal bifurcating fold oriented perpendicular to said transverse fold which together bifurcate said support section into two laterally adjacent support panels and also bifurcate said pocket section, wherein each of said support panels is rectangular with opposing faces and has mutually parallel top and bottom edges and mutually parallel lateral edges oriented perpendicular to said top and bottom edges, and said pocket section is folded to form a two pairs of pocket panels and is further folded so that said pocket panels are folded across portions of said support panels such that each of said pocket panels is folded to reside against a different face of said support panels, and each of said pocket panels is anchored to the face against which it is folded along said bottom edge thereof and along at least one of said lateral edges thereof.

4. In a folder including a folio folded to form front and back covers the improvement comprising a folder insert formed of a single sheet of flat material bifurcated by a longitudinal fold and further folded to form a pair of support panels each having opposing flat surfaces and bounded by mutually parallel top and bottom edges and mutually parallel lateral edges aligned perpendicular to said top and bottom edges, and to form two pairs of pocket panels each pair extending across both said opposing flat surfaces of a different one of said support panels and held thereto at said bottom edge thereof and at at least one of said lateral edges thereof, wherein a separate one of said support panels is interposed between said pocket panels in each of said pairs of pocket panels, which together with said pair of support panels form separate pockets with both said flat surfaces of each of said support panels, and said folder is secured to said folio at a demarcation between said front and back covers by attachment thereto along said longitudinal fold.

* * * * *